US011585208B2

(12) United States Patent
Snyder et al.

(10) Patent No.: US 11,585,208 B2
(45) Date of Patent: Feb. 21, 2023

(54) DETERMINING APPROXIMATE WELLBORE CURVATURE

(71) Applicant: Halliburton Energy Services, Inc., Houston, TX (US)

(72) Inventors: John Kenneth Snyder, Spring, TX (US); Graeme O'Brien Phillip Salmon, Spring, TX (US); Jeremy Alexander Greenwood, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 283 days.

(21) Appl. No.: 16/853,998

(22) Filed: Apr. 21, 2020

(65) Prior Publication Data

US 2021/0230999 A1 Jul. 29, 2021

Related U.S. Application Data

(60) Provisional application No. 62/967,426, filed on Jan. 29, 2020.

(51) Int. Cl.
*E21B 47/022* (2012.01)
*E21B 7/04* (2006.01)

(52) U.S. Cl.
CPC ..... *E21B 47/022* (2013.01); *E21B 7/04* (2013.01); *E21B 2200/20* (2020.05)

(58) Field of Classification Search
CPC ..... E21B 47/022; E21B 7/04; E21B 2200/20; E21B 44/00
See application file for complete search history.

(56) References Cited

U.S. PATENT DOCUMENTS 7,503,403 B2 3/2009 Jogi et al.
8,397,562 B2 * 3/2013 Wassell ..... E21B 47/007 73/152.48
10,577,918 B2 * 3/2020 Bang ..... G01V 1/40
(Continued)

OTHER PUBLICATIONS

PCT Application No. PCT/US2020/029081 , International Search Report and Written Opinion, dated Oct. 23, 2020, 10 pages.
(Continued)

*Primary Examiner* — Tara Schimpf
(74) *Attorney, Agent, or Firm* — Kilpatrick Townsend & Stockton LLP

(57) ABSTRACT

A method for configuring a bottom hole assembly (BHA) includes receiving bending moment values for the BHA, curvature values and drilling conditions for a wellbore, and processing the bending moment values to create a representation of the curvature of the drilled wellbore. Processing the bending moment values includes selecting a set of curvature values in a specified range for a selected location, calculating a bending moment value for each curvature value, and determining an actual wellbore curvature at the location by matching the received bending moment value to one of the calculated bending moment values. The method further includes generating a representation of an actual path of the wellbore using selected curvature values at a plurality of wellbore locations, comparing the actual path of the wellbore with a planned path of the wellbore; and based on the comparison, determining a configuration of the BHA to drill a next wellbore.

19 Claims, 5 Drawing Sheets

(56) References Cited

U.S. PATENT DOCUMENTS

| | | | | |
|---|---|---|---|---|
| 2005/0150689 | A1 | 7/2005 | Jogi et al. | |
| 2014/0231141 | A1 | 8/2014 | Hay et al. | |
| 2015/0075274 | A1 | 3/2015 | Kpetehoto et al. | |
| 2015/0167453 | A1 | 6/2015 | Forstner et al. | |
| 2017/0306724 | A1* | 10/2017 | Forstner | E21B 21/08 |
| 2018/0003031 | A1* | 1/2018 | Samuel | G01B 21/20 |
| 2018/0306005 | A1* | 10/2018 | Costa De Oliveira | E21B 41/00 |
| 2020/0378248 | A1* | 12/2020 | Maus | E21B 7/04 |

OTHER PUBLICATIONS

Chris et al., "Strain-Gauge Bending-Moment Measurements Used to Verify Wellbore Turtuosity", Mar. 2015, 15 pages.

* cited by examiner

| | A | B |
|---|---|---|
| 1 | | |
| 2 | Approximate Curvature ( /100') | Bending Moment (ft-lbs) |
| 3 | 1 | -3509.44 |
| 4 | 1.5 | -8783.95 |
| 5 | 2 | -14059.44 |
| 6 | 2.5 | -19247.78 |
| 7 | 3 | -24610.36 |
| 8 | 3.5 | -29885.89 |
| 9 | 4 | -35161.38 |
| 10 | 4.5 | -37628.86 |
| 11 | 5 | -45712.52 |
| 12 | 5.5 | -50988.07 |
| 13 | 6 | -56263.67 |
| 14 | | |
| 15 | | |

DETERMINING APPROXIMATE WELLBORE CURVATURE

CROSS-REFERENCES TO RELATED APPLICATIONS

This application claims the benefit of U.S. Provisional Application No. 62/967,456, filed Jan. 29, 2020, the content of which is hereby incorporated herein by reference in its entirety for all purposes.

TECHNICAL FIELD

The present disclosure relates generally to drilling operations for a wellbore and, more particularly (although not necessarily exclusively), to determining drilling equipment configurations using predicted curvature of the wellbore.

BACKGROUND

For horizontally drilled wellbores, the wellbore path may be planned using modeling software, and curvatures in the wellbore may be specified to achieve the planned wellbore path. The drilled wellbore, however, can deviate from the planned wellbore path, and the actual curvatures of the completed wellbore may be different from the curvatures specified during the planning stage. Various factors can contribute to the wellbore deviations, including drilling conditions and downhole tool configurations. Analysis of completed wellbore characteristics can provide additional information for use when planning a wellbore, configuring the downhole tools, or both.

DETAILED DESCRIPTION

Certain aspects and examples of the present disclosure relate to pre-drilling and post-drilling analysis of wellbore curvature for determining the proper downhole equipment to use for drilling a wellbore in accordance with a planned wellbore path. Bending moment values of a bottom hole assembly (BHA) of a drillstring for a wellbore that has been drilled can be processed to determine correlations to the resulting curvatures of the wellbore. By comparing the resulting curvatures to the planned curvatures, the configuration of the BHA may be verified, or modifications to the BHA may be determined, to meet the specified curvatures for drilling a subsequent wellbore. Further, this post-drilling analysis can provide pre-drilling input at the well planning stage of future wellbores to more accurately predict the planned wellbore path based on the configuration of the BHA.

Modeling software can provide pre-drilling modeling of expected bending moment values for a range of wellbore curvatures around an expected wellbore curvature. The expected bending moment values can be referenced bending moment values obtained from previously drilled wellbores to determine actual wellbore curvatures corresponding to the bending moment values. Results from the pre-drilling modeling may be used to configure a BHA to achieve the specified wellbore curvature. The model can also be utilized post-drilling to verify wellbore tortuosity and evaluate the effectiveness of the BHA configuration.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Figure 1:
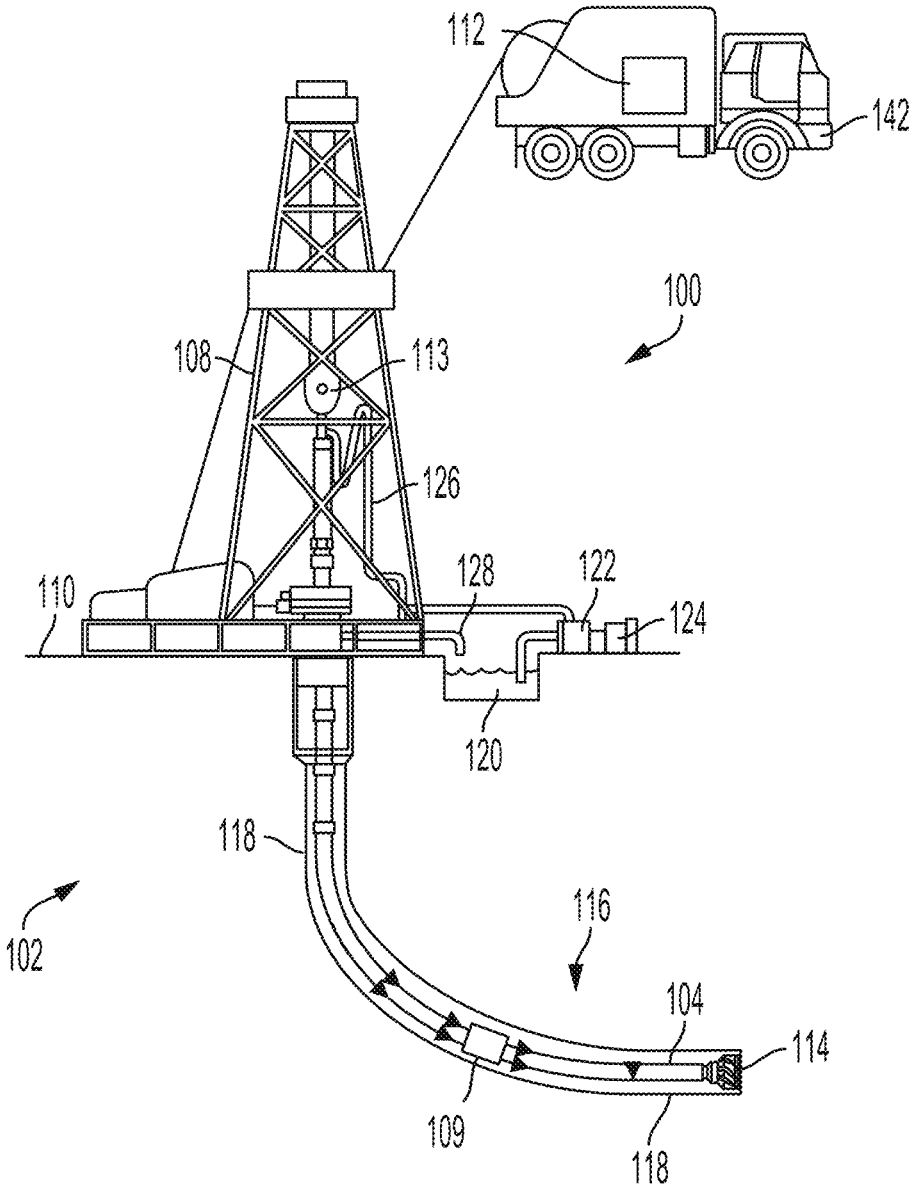
FIG. 1 is a cross-sectional view of an example of a drilling operation for a well according to one example of the present disclosure.

FIG. 1 is a cross-sectional view of an example of a drilling operation for a well according to one example of the present disclosure. A wellbore may be created by drilling into the subterranean formation 102 using the drilling system 100. The drilling system 100 may be configured to drive a bottom hole assembly (BHA) 104 positioned or otherwise arranged at the bottom of a drill string 116 extended into the subterranean formation 102 from a derrick 108 arranged at the surface 110. The derrick 108 includes a traveling block 113 used to lower and raise the drill string 116. The BHA 104 may include a drill bit 114 operatively coupled to a drill string 116, which may be moved axially within a drilled wellbore 118 as attached to the drill string 116. Drill string 116 may include one or more sensors 109 to determine a location or conditions of the drill bit and wellbore, and return values for various parameters to the surface through cabling (not shown) or by a wireless signal. The combination of any support structure (in this example, derrick 108), any motors, electrical equipment and connections, and support for the drill string and tool string may be referred to herein as a drilling arrangement.

During operation, the drill bit 114 penetrates the earth 102 and thereby creates the wellbore 118. The BHA 104 provides control of the drill bit 114 as it advances into the earth 102. Control of the drill bit includes rotation and sliding as induced by a motor, which in some examples is a mud motor, or a rotary steerable tool or both as part of the BHA 104. A mud motor is part of the drill string and can use, at least in part, the hydraulic power of the drilling fluid to operate. Fluid or "mud" from a mud tank 120 may be pumped downhole using a mud pump 122 powered by an adjacent power source, such as a prime mover or motor 124.

The mud may be pumped from the mud tank 120, through a stand pipe 126, which feeds the mud into the drill string 116 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drill string 116, and in the process returns the drill cuttings and debris to the surface. The cuttings and mud mixture are passed through a flow line 128 and are processed such that a cleaned mud is returned down hole through the stand pipe 126 once again.

Still referring to FIG. 1, the drilling arrangement and any sensors 109 (through the drilling arrangement or directly) are connected to a computing device 112. The computing device 112 can be positioned at the well surface 110 or elsewhere (e.g., offsite). The computing device 112 may be in communication with the drill string 116, the sensor 109, or another electronic device. For example, the computing device 112 can have a communication interface for transmitting information to and receiving information from another communication interface of the tool string.

In some examples, the computing device 112 can receive data from downhole (or elsewhere). The data can include information related to the well system 100. For example, the drill string 116 can transmit data to the computing device 112, where the data includes information about the orientation or location of the drill bit 114 or the bending moment of a bottom hole assembly 104 in the wellbore 118. The computing device 112 can use the data to determine a location of the drill bit relative to a drill path and waypoints. A more specific example of the computing device 112 is described in greater detail below with respect to FIG. 2.

Figure 2:
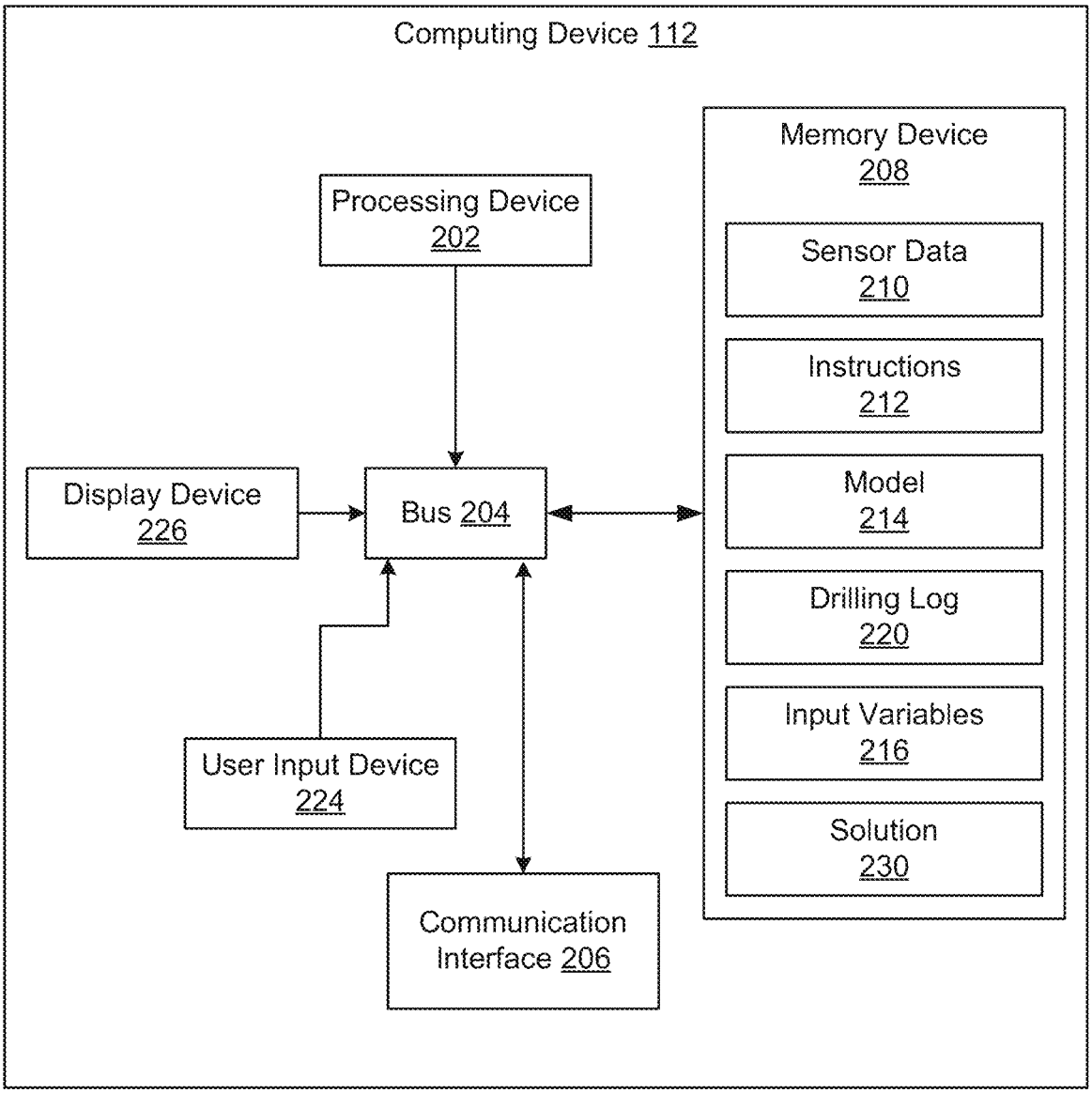
FIG. 2 illustrates an example of a computing device for determining an approximate wellbore curvature according to one example of the present disclosure.

FIG. 2 illustrates an example of a computing device 112 for determining an approximate wellbore curvature according to one example of the present disclosure. The computing device 112 can include a processing device 202, a bus 204, a communication interface 206, a memory device 208, a user input device 224, and a display device 226. In some examples, some or all of the components shown in FIG. 2 can be integrated into a single structure, such as a single housing. In other examples, some or all of the components shown in FIG. 2 can be distributed (e.g., in separate housings) and in communication with each other.

The processing device 202 can execute one or more operations for path planning and optimizing parameters for a drilling operation. The processing device 202 can execute instructions 212 stored in the memory device 208 to perform the operations. The processing device 202 can include one processing device or multiple processing devices. Non-limiting examples of the processing device 202 include a Field-Programmable Gate Array ("FPGA"), an application-specific integrated circuit ("ASIC"), a microprocessor, etc.

The processing device 202 can be communicatively coupled to the memory device 208 via the bus 204. The non-volatile memory device 208 may include any type of memory device that retains stored information when powered off. Non-limiting examples of the memory device 208 include electrically erasable and programmable read-only memory ("EEPROM"), flash memory, or any other type of non-volatile memory. In some examples, at least some of the memory device 208 can include a non-transitory medium from which the processing device 202 can read instructions. A computer-readable medium can include electronic, optical, magnetic, or other storage devices capable of providing the processing device 202 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C#, etc.

The memory device 208 can include modeling software 214. In some examples, the memory device 208 can include sensor data 210, for example, location data 210 (e.g., locations of waypoints, starting points, and ending points), strain gauge data, etc. The memory device 208 may store solutions 230 generated by the modeling software 214. The memory device 208 can also include a database of input variables, such as weight on bit (WOB), mud weight, inclination, bending moment, for the modeling software 214, as well as constraints such as kinematics constraints, safety constraints, and range constraints related to the drill string and drill bit. In some examples, the memory device 208 can include a computer program code instructions 212 for executing the model 214, as well as for control of other aspects of the drilling operation. The memory device 208 can include computer program instructions for optimization calculations for the drill path, as well as other data related to the drilling operation that may be stored in a drilling plan 220.

In some examples, the computing device 112 includes a communication interface 206. The communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or other mobile communications network).

In some examples, the computing device 112 includes a user input device 224. The user input device 224 can represent one or more components used to input data. Examples of the user input device 224 can include a keyboard, mouse, touchpad, button, or touch-screen display, etc. In some examples, the computing device 112 includes a display device 226. The display device 226 can represent one or more components used to output data. Examples of the display device 226 can include a liquid-crystal display (LCD), a computer monitor, a touch-screen display, etc. In some examples, the user input device 916 and the display device 226 can be a single device, such as a touch-screen display.

Some aspects of the present disclosure employ computer program instructions that implement drilling model software to derive an approximate curvature of a wellbore from measured bending moment values. The computer program instructions may include instructions for selecting a point of interest from a drilling plan, and at the point of interest, obtaining input variables from a database. The input variables may reflect actual drilling conditions obtained from a wellbore that has been drilled. The input variables may include, for example, but not limited to, WOB, wellbore inclination, mud weight, bending moment for the BHA, etc., as well as a detailed model of the BHA including, for example, distance from the drill bit of a sensor utilized to measure the bending moment of the BHA, stiffness of the BHA, etc.

The computer program instructions may cause the execution of the drilling model software to approximate the curvature of a planned wellbore. The drilling model software may perform sensitivity analysis at various locations along the planned wellbore to determine the curvatures at the locations. To perform the sensitivity analysis, a measured bending moment value for a BHA and a curvature value at a location of interest along a wellbore that has been drilled using the BHA, as well as the drilling conditions at the location may be obtained. The data may be obtained, for example, from a database containing information related to previously drilled wellbores. A set of curvatures values may be selected in a range both greater than and less than the obtained curvature value, and BHA bending moment values for each curvature value in the range may be calculated under the drilling conditions applied for the point of interest. An actual curvature value of the previously drilled wellbore may be determined as the curvature value corresponding to the calculated bending moment value closest to the obtained bending moment value of the previously drilled wellbore.

An actual wellbore path of the previously drilled wellbore that is determined based on the results of the sensitivity analysis of the drilling model software may be compared to the wellbore path plan for the previously drilled well to determine the performance of the BHA. Based on the comparison, the drilling model software may suggest modifications to the configuration of the BHA, or verify the configuration of the BHA, that was used to drill the wellbore to achieve the planned curvature values at the various points of interest along the wellbore.

Figure 3:
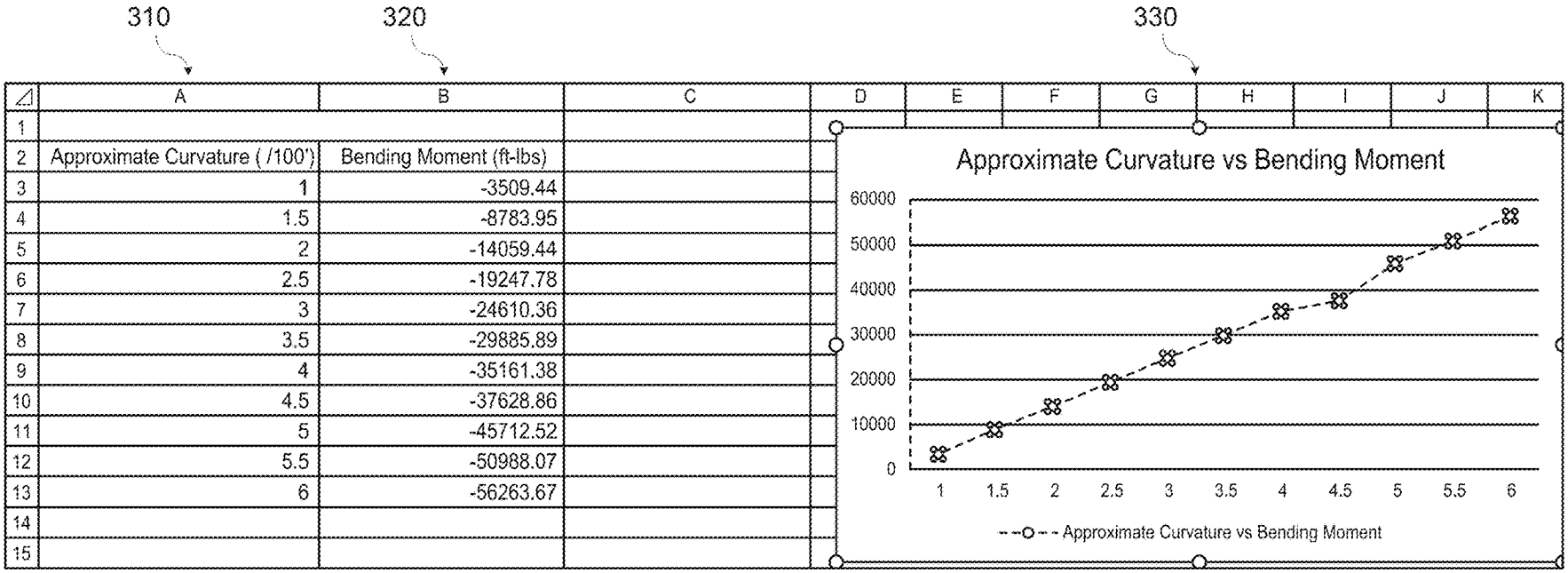
FIG. 3 illustrates an example of an output from the drilling model software of the approximate wellbore curvature based on the bending moment of a bottom hole assembly (BHA) according to one example of the present disclosure.

The computer may generate approximate curvature values and corresponding bending moment values as output in table form, graphical form, or both. FIG. 3 illustrates an example of an output from the drilling model software of the approximate wellbore curvature based on the bending moment of the BHA according to one example of the present disclosure. Referring to FIG. 3, the first column 310 of the spreadsheet illustrates the approximate curvature values of a wellbore corresponding bending moment values of the BHA shown in column two 320 calculated by the drilling model software. The plot 330 presents the approximate curvature versus bending moment values in graphical form. In some implementations, the results may be used for further calculations and analysis by the computer and may not be output.

The computer may examine the results to determine a calculated bending moment value for the BHA that most closely corresponds to a measured bending moment value obtained from a wellbore that has been drilled to determine the actual curvature value. desired approximate curvature for the planned wellbore. Based on the results from the drilling model, the computer may verify that the configuration of the BHA was appropriate for the wellbore that was drilled, or may suggest changes to the BHA configuration, for example, rearranging components or using alternate components.

Figure 4:
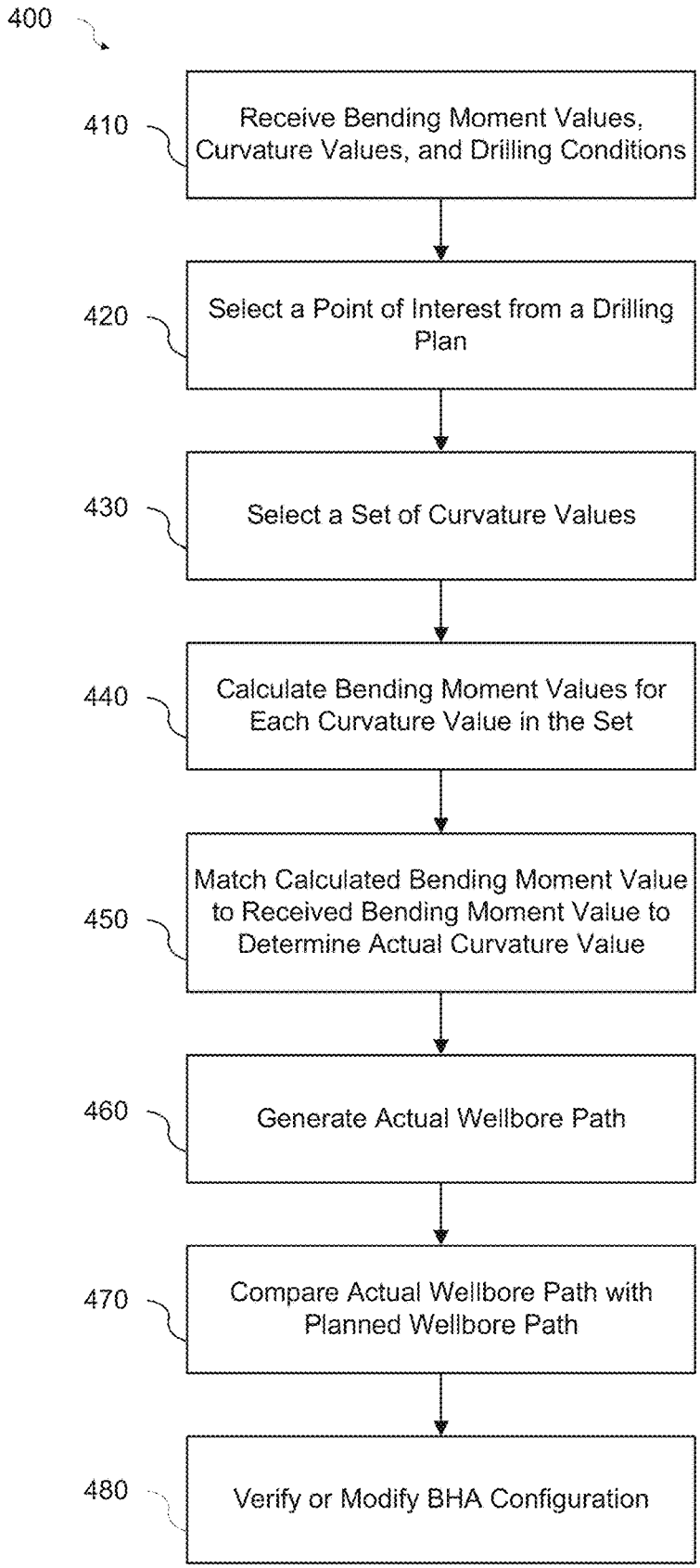
FIG. 4 is a flowchart illustrating an example of a process for predicting the approximate curvature of the wellbore according to one example of the present disclosure.

FIG. 4 is a flowchart illustrating an example of a process 400 for predicting the approximate curvature of the wellbore according to one example of the present disclosure. Referring to FIG. 4, at block 410 bending moment values, curvature values, and drilling conditions may be received as input to a drilling model executing on a computer. The curvature values may be curvature values for a wellbore that has been drilled. The bending moment values may be for the BHA used to drill the wellbore, and may correspond to the curvature values. The drilling conditions may be actual drilling conditions used when the wellbore was drilled. The bending moment values, curvature values, and drilling conditions may be received for a plurality of locations along the wellbore. The bending moment values, curvature values, and drilling conditions may be obtained from a database. The database may include BHA, wellbore, and drilling characteristics from previously drilled wellbores.

The drilling conditions may include, for example, but not limited to, WOB, wellbore inclination, mud weight, bending moment direction, BHA characteristics, etc., may be obtained from a database. The database may include wellbore and drilling characteristics from previously drilled wellbores that may approximate the conditions of the wellbore being planned.

In some cases, actual bending moments may be obtained from sensor measurements after a wellbore has been drilled. For example, after the wellbore has been drilled, the BHA including the measurement tool may be run back through the wellbore, and bending moment measurements may be taken. The bending moment measurements may be taken at specified intervals along the wellbore. The bending moment measurements may be taken at intervals along the wellbore that are shorter than the distance between wellbore survey stations and can produce a more accurate representation of the wellbore curvature.

At block 420, a point of interest from a drilling plan may be selected. The point of interest may be selected by program instructions executing the model. Alternatively, the point of interest may be selected based on user input to the computer.

At block 430, a set of curvature values at the point of interest may be selected. The set of curvature values may be selected in a specified range around a received curvature value for the location. The specified range may include the received curvature value and curvature values less than and greater than the received curvature value. The range of curvature values may be determined by the model or may be received as input from a user.

At block 440, bending moment values may be calculated for each curvature value in the set of curvature values. The model may calculate a bending moment value for the BHA at each curvature value in the set of curvature values using the received drilling conditions for the selected point of interest and a detailed model of the BHA. The computer may perform a sensitivity analysis at the point of interest in the wellbore by sweeping the set of curvature values across the range of values and calculating the bending moment value corresponding to each curvature value while maintaining constant values for the other input variables, for example, but not limited to, WOB, wellbore inclination, mud weight, BHA characteristics, etc.

At block 450, an actual curvature value for the wellbore may be determined. The received bending moment value for the point of interest may be matched to the closest bending moment value calculated by the model. The curvature value from the set of curvature values that corresponds to the closest calculated bending moment value will be the approximate actual curvature of the wellbore at the point of interest. For example, referring again to FIG. 3, if a bending moment value of 29885.89 ft-lbs applied to the BHA was the closest match to the received bending moment value, the approximate actual curvature of the wellbore would be 3.5 degrees per 100 feet at the selected point of interest.

At block 460, an actual wellbore path may be generated. The process of blocks 410-450 may be iterated for each of the plurality of points along the wellbore for which data was received. The actual curvature values determined based on the curvature values corresponding to the matches between the received bending moment values and the calculated bending moment values. The output of the model may be input into well planning software, and a new representation of the previously wellbore path may be generated using the actual curvature values.

At block 470, the actual wellbore path and the planned wellbore path may be compared. Software executing on the computer may determine the differences in curvature values between the planned wellbore path and the actual wellbore path as determined by the model.

At block 480, the BHA configuration may be verified or modified. Based on the results of the comparison between the approximate actual curvature values and the predicted curvature values of the planned wellbore path, the computer may generate a BHA configuration that verifies the modeled BHA configuration or suggests modifications to the BHA configuration to more accurately achieve the desired wellbore curvature.

In some cases, after the wellbore has been drilled, the BHA including the measurement tool may be run back through the wellbore, and bending moment measurements may be taken to verify the accuracy of the wellbore curvature. The bending moment measurements may be taken at specified intervals along the wellbore. The bending moment measurements may be taken at intervals along the wellbore that are shorter than the distance between wellbore survey stations and can produce a more accurate representation of the wellbore curvature. The information obtained from the post-drilling measurements may be used to increase the accuracy of determining a BHA configuration.

The process illustrated in FIG. 4 provides a particular method for predicting the approximate curvature of the wellbore according to an embodiment. Other sequences of steps may also be performed according to alternative embodiments. For example, alternative embodiments may perform the steps outlined above in a different order. Moreover, the individual steps illustrated in FIG. 4 may include multiple sub-steps that may be performed in various sequences as appropriate to the individual step. Furthermore, additional steps may be added or removed depending on the particular applications. One of ordinary skill in the art would recognize many variations, modifications, and alternatives.

The method 400 may be embodied on a non-transitory computer readable medium, for example, but not limited to, the memory device 208 or other non-transitory computer readable medium known to those of skill in the art, having stored therein a program including computer executable instructions for making a processor, computer, or other programmable device execute the operations of the methods.

According to some aspects of the present disclosure, the results of the sensitivity analysis of the drilling model software may be utilized during the pre-drilling stage of a wellbore to determine a configuration of a BHA. Improvements to the accuracy of both the wellbore planning software and the configuration of the BHA may be achieved using bending moment measurements obtained from a that has been drilled to refine the drilling model.

Figure 5:
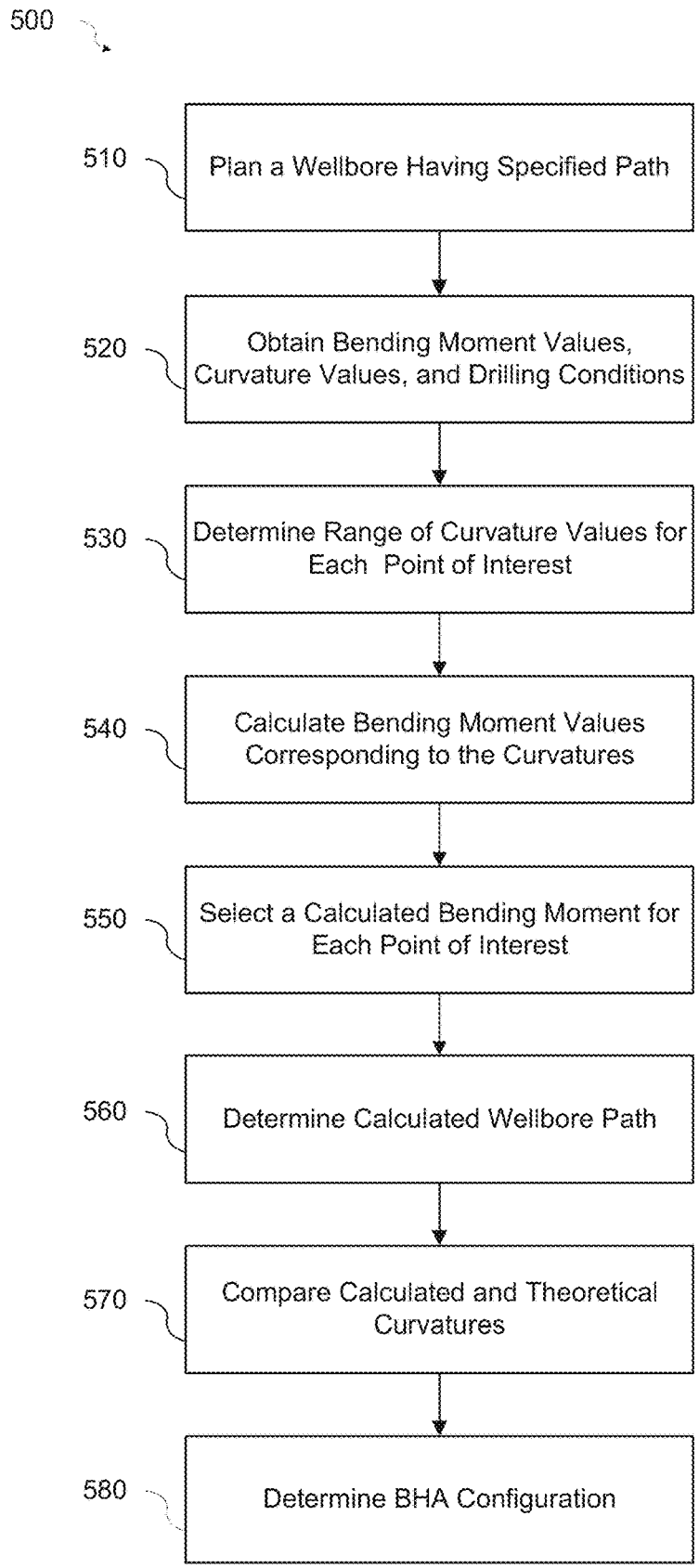
FIG. 5 is a flowchart illustrating an example of a method for configuring a bottom hole assembly (BHA) of a drill string according to one example of the present disclosure.

FIG. 5 is a flowchart illustrating a method 500 for configuring a bottom hole assembly (BHA) of a drill string according to one example of the present disclosure. Referring to FIG. 5, at block 510, a wellbore having a specified path may be planned. Wellbore planning software may be used to plan the theoretical path of a wellbore prior to drilling the wellbore.

At block 520, bending moment values, curvature values, and drilling conditions may be obtained and input to the planning software executing on a computer. The curvature values may be curvature values for a similar wellbore that has been drilled, for example, a wellbore drilled in a similar geologic formation. The bending moment values may be for the BHA used to drill the similar wellbore, and may correspond to the curvature values. The drilling conditions may be actual drilling conditions used when the wellbore was drilled.

The bending moment values, curvature values, and drilling conditions may be received for a plurality of locations along the wellbore. The drilling conditions may include, for example, but not limited to, WOB, wellbore inclination, mud weight, bending moment direction, BHA characteristics, etc., may be obtained from a database. The database may include wellbore and drilling characteristics from previously drilled wellbores that may approximate the conditions of the wellbore being planned.

At block 530, for each point of interest along the planned wellbore path, a range of curvatures at a specified point may be calculated. A point of interest along the wellbore may be selected based on a drilling plan, and may be a point where a curvature in the wellbore is planned. At each point of interest, a set of curvature values at the point of interest may be selected. The set of curvature values may be selected in a specified range around a specified curvature value planned for the location. The specified range may include the specified curvature value and curvature values less than and greater than the received curvature value. The range of curvature values may be determined by the planning software or may be received as input from a user.

At block 540, bending moments corresponding to the curvature values may be calculated. The software executing on the computer may calculate a bending moment value for the BHA at each curvature value in the set of curvature values using the obtained drilling conditions for the selected point of interest and a detailed model of the BHA. The computer may perform a sensitivity analysis at each point of interest in the wellbore by sweeping the set of curvature values across the range of values and calculating the bending moment value corresponding to each curvature value while maintaining constant values for the other input variables, for example, but not limited to, WOB, wellbore inclination, mud weight, bending moment direction, BHA characteristics, etc., that are input to the model may be held constant during the sensitivity analysis.

At block 550, a calculated bending moment value for each point of interest may be selected. Based on the results of the sensitivity analysis performed at each point of interest, a bending moment value corresponding to the specified curvature value of the wellbore from the bending moments corresponding to the range of curvatures may be selected. The selected bending moment value may be the bending moment for the curvature that most closely corresponds to the specified curvature at the specified point from the wellbore planning model. The calculated bending moment may be selected by the software executing on the computer or may be selected based on user input.

At block 560, a calculated wellbore path may be determined. The calculated bending moment values selected for each point of interest may be used to determine a representation of the actual wellbore path that would result. The selected bending moment values for each point of interest may be input into the wellbore path planning software and the resulting representation of the wellbore path may be generated. The calculated curvature of the wellbore path determined based on the selected bending moment values may provide a more accurate representation of the curvature of the wellbore path.

At block 570, the calculated and theoretical curvatures of the wellbore path may be compared. The wellbore planning software, may compare the actual wellbore curvature to the originally determined theoretical wellbore curvature.

At block 580, a configuration of the BHA may be determined. The results of the comparison of the calculated wellbore curvature to the theoretical wellbore curvature originally determined from the wellbore planning software may be used to verify the BHA configuration or to modify the BHA configuration. For example, the computer executing the wellbore planning software may analyze the results of the comparison. When the comparison indicates that the deviation between the calculated wellbore path and the theoretical planned wellbore path is within a specified threshold, the software may indicate that the modeled BHA configuration is acceptable for drilling the wellbore.

When the comparison indicates that the deviation between the calculated wellbore path and the theoretical planned wellbore path is not within a specified threshold, the software may suggest modifications to the BHA when the comparison indicates that the wellbore path that would be drilled using the modeled BHA configuration would result in too much deviation of the wellbore path from the originally planned theoretical wellbore path. Modifications to the BHA suggested by the software may be, for example, but not limited to, rearranging components of the BHA, adding components to the BHA, removing components from the BHA, or substituting alternate components in the BHA. In some implementations, accuracy of the wellbore planning model may be improved by incorporating the results of the comparison into models used by the software for calculating the wellbore curvature.

The process illustrated in FIG. 5 provides a particular method for configuring a bottom hole assembly (BHA) of a drill string according to an embodiment of the present disclosure. Other sequences of steps may also be performed according to alternative embodiments. For example, alternative embodiments may perform the steps outlined above in a different order. Moreover, the individual steps illustrated in FIG. 5 may include multiple sub-steps that may be performed in various sequences as appropriate to the individual step. Furthermore, additional steps may be added or removed depending on the particular applications. One of ordinary skill in the art would recognize many variations, modifications, and alternatives.

The method 500 may be embodied on a non-transitory computer readable medium, for example, but not limited to, the memory device 208 or other non-transitory computer readable medium known to those of skill in the art, having stored therein a program including computer executable instructions for making a processor, computer, or other programmable device execute the operations of the methods.

In some implementations, the processes illustrated in FIGS. 4 and 5 may be used together to plan a wellbore and configure a bottom hole assembly (BHA) of a drill string to achieve a planned wellbore path.

In some aspects, a system and method for determining the approximate curvature of a wellbore is provided according to one or more of the following examples. As used below, any reference to a series of examples is to be understood as a reference to each of those examples disjunctively (e.g., "Examples 1-4" is to be understood as "Examples 1, 2, 3, or 4").

Example 1 is a method for configuring a bottom hole assembly (BHA) of a drill string, including receiving bending moment values for the BHA, and curvature value, and drilling conditions for a wellbore that was drilled using the BHA; processing the received bending moment values to create a representation of the curvature of the wellbore that was drilled, wherein processing the bending moment values includes, for each of a plurality of locations along the wellbore: selecting a location from the plurality of locations, selecting a set of curvature values in a specified range around a received curvature value for the location, wherein the specified range includes the received curvature value and curvature values less than and greater than the received curvature value, calculating a bending moment value for the BHA at each curvature value in the set of curvature values using the received drilling conditions for the selected location, and determining an actual curvature of the wellbore at the selected location by matching the received bending moment value to one of the calculated bending moment values and selecting a curvature value from the set of curvature values corresponding to the calculated bending moment; generating a representation of an actual path of the wellbore using the selected curvature value at each of the plurality of locations along the wellbore; comparing the actual path of the wellbore with a planned path of the wellbore; and based on the comparison, determining a configuration of the BHA to drill a next wellbore.

Example 2 is the method of example(s) 1, wherein determining a configuration of the BHA to drill a next wellbore includes validating a current configuration of the BHA.

Example 3 is the method of example(s) 1-2, wherein determining a configuration of the BHA to drill a next wellbore includes suggesting modifications to the configuration of the BHA.

Example 4 is the method of example(s) 1-3, wherein suggested modifications to the configuration of the BHA include rearranging components of the BHA, adding components to the BHA, removing components from the BHA, or substituting alternate components in the BHA.

Example 5 is the method of example(s) 1-4, wherein comparing the actual path of the wellbore with a planned path of the wellbore includes: generating, using a planning model, a representation of the planned path for the wellbore; updating the planning model using the selected curvature value at each of the plurality of locations along the wellbore; and generating, using the planning model, the representation of the actual path of the wellbore.

Example 6 is the method of example(s) 1-5, wherein the received drilling conditions include one or more of weight on bit (WOB), wellbore inclination, mud weight, bending moment direction, or bottom hole assembly (BHA) characteristics.

Example 7 is the method of example(s) 1-6, further including planning the next wellbore by: inputting, to a planning model, curvature values for a path of the next wellbore, wherein the curvature values are determined based on the calculated bending moment values for a corresponding configuration of the BHA.

Example 8 is a system including: a downhole measurement tool configured to provide bending moment measurements of a bottom hole assembly (BHA) of a drill string; a memory; and a computer configured to communicate with the downhole measurement tool and the memory, the computer further configured to: receive bending moment values for the BHA, and curvature values and drilling conditions for a wellbore that was drilled using the BHA; process the received bending moment values to create a representation of the curvature of the wellbore that was drilled, wherein processing the received bending moment values includes, for each of a plurality of locations along the wellbore: selecting a location from the plurality of locations, selecting a set of curvature values in a specified range around a received curvature value for the location, wherein the specified range includes the received curvature value and curvature values less than and greater than the received curvature value, calculating a bending moment value for the BHA at each curvature value in the set of curvature values using the received drilling conditions for the selected location, and determining an actual curvature of the wellbore at the selected location by matching the received bending moment value to one of the calculated bending moment values and selecting a curvature value from the set of curvature values corresponding to the calculated bending moment; generate a representation of an actual path of the wellbore using the selected curvature value at each of the plurality of locations along the wellbore; compare the actual path of the wellbore with a planned path of the wellbore; and based on the comparison, determine a configuration of the BHA to drill a next wellbore.

Example 9 is the system of example(s) 8, wherein determining a configuration of the BHA to drill a next wellbore includes validating a current configuration of the BHA.

Example 10 is the system of example(s) 8-9, wherein determining a configuration of the BHA to drill a next wellbore includes suggesting modifications to the configuration of the BHA.

Example 11 is the system of example(s) 8-10, wherein suggested modifications to the configuration of the BHA include rearranging components of the BHA, adding components to the BHA, removing components from the BHA, or substituting alternate components in the BHA.

Example 12 is the system of example(s) 8-11, wherein comparing the actual path of the wellbore with a planned path of the wellbore includes: generating, using a planning model, a representation of the planned path of the wellbore; updating the planning model using the selected curvature value at each of the plurality of locations along the wellbore; and generating, using the planning model, the representation of the actual path of the wellbore.

Example 13 is the system of example(s) 8-12, wherein the received drilling conditions include one or more of weight on bit (WOB), wellbore inclination, mud weight, bending moment direction, or bottom hole assembly (BHA) characteristics.

Example 14 is a non-transitory computer-readable medium having stored therein instructions for making a processor execute a method for configuring a bottom hole assembly (BHA) of a drill string, the processor-executable instructions including instructions for performing operations including: receiving bending moment values for the BHA, and curvature values and drilling conditions for a wellbore that was drilled using the BHA; processing the received bending moment values to create a representation of the curvature of the wellbore that was drilled, wherein processing the bending moment values includes, for each of a plurality of locations along the wellbore: selecting a location from the plurality of locations, selecting a set of curvature values in a specified range around a received curvature value for the location, wherein the specified range includes the received curvature value and curvature values less than and greater than the received curvature value, calculating a bending moment value for the BHA at each curvature value in the set of curvature values using the received drilling conditions for the selected location, and determining an actual curvature of the wellbore at the selected location by matching the received bending moment value to one of the calculated bending moment values and selecting a curvature value from the set of curvature values corresponding to the calculated bending moment; generating a representation of an actual path of the wellbore using the selected curvature value at each of the plurality of locations along the wellbore; comparing the actual path of the wellbore with a planned path of the wellbore; and based on the comparison, determining a configuration of the BHA to drill a next wellbore.

Example 15 is the non-transitory computer-readable medium of example(s) 14, wherein the instructions for determining a configuration of the BHA to drill a next wellbore include validating a current configuration of the BHA.

Example 16 is the non-transitory computer-readable medium of example(s) 14-15, wherein the instructions for determining a configuration of the BHA to drill a next wellbore include suggesting modifications to the configuration of the BHA.

Example 17 is the non-transitory computer-readable medium of example(s) 14-16, wherein suggested modifications to the configuration of the BHA include rearranging components of the BHA, adding components to the BHA, removing components from the BHA, or substituting alternate components in the BHA.

Example 18 is the non-transitory computer-readable medium of example(s) 14-17, wherein instructions for comparing the actual path of the wellbore with a planned path of the wellbore include: generating, using a planning model, a representation of a specified path for the wellbore; updating the planning model using the selected curvature value at each of the plurality of locations along the wellbore; and generating, using the planning model, the representation of the actual path of the wellbore.

Example 19 is the non-transitory computer-readable medium of example(s) 14-18, wherein the drilling conditions include one or more of weight on bit (WOB), wellbore inclination, mud weight, bending moment direction, or bottom hole assembly (BHA) characteristics.

Example 20 is the non-transitory computer-readable medium of example(s) 14-19, further including instructions for planning the next wellbore by: inputting, to a planning model, curvature values for a path of the next wellbore, wherein the curvature values are determined based on the calculated bending moment values for a corresponding configuration of the BHA.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method for configuring a bottom hole assembly (BHA) of a drill string based on post-drilling analysis of a previously drilled wellbore, the method comprising:

after a downhole measurement tool has been retrieved to a surface of the previously drilled wellbore, controlling the downhole measurement tool on a drill string to obtain bending moment values and curvature values and drilling conditions from the previously drilled wellbore while the drill string is being run down the previously drilled wellbore after drilling is completed, wherein the drill string comprises the BHA used for drilling the previously drilled wellbore;

receiving the bending moment values for the BHA, and the curvature values and drilling conditions for the previously drilled wellbore that was drilled using the BHA;

processing the received bending moment values to create a representation of a curvature of the previously drilled wellbore, wherein processing the received bending moment values comprises, for each of a plurality of locations along the previously drilled wellbore:

selecting a location from the plurality of locations, selecting a set of curvature values in a specified range around a received curvature value for the location, wherein the specified range includes the received curvature value and curvature values less than and greater than the received curvature value, calculating a bending moment value for the BHA at each curvature value in the set of curvature values using the received drilling conditions for the selected location, and determining an actual curvature of the previously drilled wellbore at the selected location by matching the received bending moment value to one of the calculated bending moment values and selecting a curvature value from the set of curvature values corresponding to the calculated bending moment;

generating a representation of an actual path of the previously drilled wellbore using the selected curvature value at each of the plurality of locations along the previously drilled wellbore;

comparing the actual path of the previously drilled wellbore with a planned path of the previously drilled wellbore; and based on results of the comparison, outputting a configuration of the BHA to drill a next wellbore such that the next wellbore achieves a trajectory corresponding to a planned trajectory.

2. The method of claim 1, wherein determining a configuration of the BHA to drill a next wellbore comprises validating a current configuration of the BHA.

3. The method of claim 1, wherein modifying the configuration of the BHA comprises rearranging components of the BHA, adding components to the BHA, removing components from the BHA, or substituting alternate components in the BHA.

4. The method of claim 1, wherein comparing the actual path of the previously drilled wellbore with a planned path of the previously drilled wellbore comprises:

generating, using a planning model, a representation of the planned path for the previously drilled wellbore;

updating the planning model using the selected curvature value at each of the plurality of locations along the previously drilled wellbore; and generating, using the planning model, the representation of the actual path of the previously drilled wellbore.

5. The method of claim 1, wherein the received drilling conditions include one or more of weight on bit (WOB), wellbore inclination, mud weight, bending moment direction, or bottom hole assembly (BHA) characteristics.

6. The method of claim 1, further comprising planning the next wellbore by:

inputting, to a planning model, curvature values for a path of the next wellbore, wherein the curvature values are determined based on the calculated bending moment values for a corresponding configuration of the BHA.

7. A system comprising:

a drill string comprising a bottom hole assembly (BHA);

a downhole measurement tool configured to provide bending moment measurements of the BHA of the drill string for a previously drilled wellbore;

a memory; and a computer configured to communicate with the downhole measurement tool and the memory, the computer further configured to:

after the downhole measurement tool has been retrieved to a surface of the previously drilled wellbore, control the downhole measurement tool to obtain bending moment values and curvature values and drilling conditions from the previously drilled wellbore while the drill string is being run down the previously drilled wellbore after drilling is completed;

receive, from the downhole measurement tool, the bending moment values for the BHA, and curvature values and drilling conditions for the previously drilled wellbore that was drilled using the BHA obtained by running the drill string comprising the BHA used for drilling the previously drilled wellbore down the previously drilled wellbore after the wellbore i& drilling is completed;

process the received bending moment values to create a representation of the curvature of the previously drilled wellbore, wherein processing the received bending moment values comprises, for each of a plurality of locations along the previously drilled wellbore:

selecting a location from the plurality of locations, selecting a set of curvature values in a specified range around a received curvature value for the location, wherein the specified range includes the received curvature value and curvature values less than and greater than the received curvature value, calculating a bending moment value for the BHA at each curvature value in the set of curvature values using the received drilling conditions for the selected location, and determining an actual curvature of the previously drilled wellbore at the selected location by matching the received bending moment value to one of the calculated bending moment values and selecting a curvature value from the set of curvature values corresponding to the calculated bending moment;

generate a representation of an actual path of the previously drilled wellbore using the selected curvature value at each of the plurality of locations along the previously drilled wellbore;

compare the actual path of the previously drilled wellbore with a planned path of the previously drilled wellbore; and output, based on results of the comparison, a configuration of the BHA is for drilling a next wellbore such that the next wellbore achieves a trajectory corresponding to a planned trajectory.

8. The system of claim 7, wherein determining a configuration of the BHA to drill a next wellbore comprises validating a current configuration of the BHA.

9. The system of claim 7, wherein determining a configuration of the BHA to drill a next wellbore comprises suggesting modifications to the configuration of the BHA.

10. The system of claim 9, wherein suggested modifications to the configuration of the BHA comprise rearranging components of the BHA, adding components to the BHA, removing components from the BHA, or substituting alternate components in the BHA.

11. The system of claim 7, wherein comparing the actual path of the previously drilled wellbore with a planned path of the previously drilled wellbore comprises:

generating, using a planning model, a representation of the planned path of the previously drilled wellbore;

updating the planning model using the selected curvature value at each of the plurality of locations along the previously drilled wellbore; and generating, using the planning model, the representation of the actual path of the previously drilled wellbore.

12. The system of claim 7, wherein the received drilling conditions include one or more of weight on bit (WOB), wellbore inclination, mud weight, bending moment direction, or bottom hole assembly (BHA) characteristics.

13. A non-transitory computer-readable medium having stored therein instructions for making a processor execute a method for configuring a bottom hole assembly (BHA) of a drill string for a next wellbore based on post-drilling analysis of a previously drilled wellbore, the processor-executable instructions comprising instructions for performing operations including:

after a downhole measurement tool has been retrieved to a surface of the previously drilled wellbore, controlling the downhole measurement tool on a drill string to obtain bending moment values and curvature values and drilling conditions from a previously drilled wellbore while the drill string is being run down the previously drilled wellbore after drilling is completed, wherein the drill string comprises the BHA used for drilling the previously drilled wellbore;

receiving the bending moment values for the BHA, and the curvature values and drilling conditions for the previously drilled wellbore that was drilled using the BHA;

processing the received bending moment values to create a representation of the curvature of the wellbore that was drilled, wherein processing the received bending moment values comprises, for each of a plurality of locations along the wellbore:

selecting a location from the plurality of locations, selecting a set of curvature values in a specified range around a received curvature value for the location, wherein the specified range includes the received curvature value and curvature values less than and greater than the received curvature value, calculating a bending moment value for the BHA at each curvature value in the set of curvature values using the received drilling conditions for the selected location, and determining an actual curvature of the wellbore at the selected location by matching the received bending moment value to one of the calculated bending moment values and selecting a curvature value from the set of curvature values corresponding to the calculated bending moment;

generating a representation of an actual path of the wellbore using the selected curvature value at each of the plurality of locations along the wellbore;

comparing the actual path of the previously drilled wellbore with a planned path of the previously drilled wellbore; and outputting, based on results of the comparison, a configuration of the BHA to drill the next wellbore such that the next wellbore achieves a trajectory corresponding to a planned trajectory.

14. The non-transitory computer-readable medium of claim 13, wherein the instructions for determining a configuration of the BHA to drill a next wellbore include validating a current configuration of the BHA.

15. The non-transitory computer-readable medium of claim 13, wherein the instructions for determining a configuration of the BHA to drill a next wellbore include suggesting modifications to the configuration of the BHA.

16. The non-transitory computer-readable medium of claim 15, wherein suggested modifications to the configuration of the BHA include rearranging components of the BHA, adding components to the BHA, removing components from the BHA, or substituting alternate components in the BHA.

17. The non-transitory computer-readable medium of claim 13, wherein instructions for comparing the actual path of the wellbore with a planned path of the wellbore include:

generating, using a planning model, a representation of a specified path for the wellbore;

updating the planning model using the selected curvature value at each of the plurality of locations along the well bore; and generating, using the planning model, the representation of the actual path of the wellbore.

18. The non-transitory computer-readable medium of claim 13, wherein the drilling conditions include one or more of weight on bit (WOB), wellbore inclination, mud weight, bending moment direction, or bottom hole assembly (BHA) characteristics.

19. The non-transitory computer-readable medium of claim 13, further comprising instructions for planning the next wellbore by:

inputting, to a planning model, curvature values for a path of the next wellbore, wherein the curvature values are determined based on the calculated bending moment values for a corresponding configuration of the BHA.

* * * * *